US005940654A

United States Patent [19]

Uchiyama et al.

[11] Patent Number: 5,940,654

[45] **Date of Patent: *Aug. 17, 1999**

[54] IMAGE FORMING APPARATUS WITH DEVELOPMENT CONTROL BASED ON DENSITY DETECTION OF DEVELOPED CONTROL IMAGE

[75] Inventors: Akihiko Uchiyama; Hiroshi Sasame, both of Yokohama; Tatsuya Kobayashi, Sohka; Youichirou Maebashi, Yokohama, all of Japan

[73] Assignee: Canon Kabushki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/772,584

[22] Filed: Dec. 26, 1996

Related U.S. Application Data

[63] Continuation of application No. 08/359,729, Dec. 20, 1994, abandoned.

[30] Foreign Application Priority Data

Dec. 20, 1993 [JP] Japan ..... 5-320014

[51] Int. Cl.[6] ..... G03G 15/08

[52] U.S. Cl. ..... 399/49; 399/72

[58] Field of Search ..... 399/46, 49, 53, 399/55, 58–59, 72

[56] References Cited

U.S. PATENT DOCUMENTS

| | | | |
|---|---|---|---|
| 4,618,248 | 10/1986 | Buchar | 399/72 |
| 4,887,102 | 12/1989 | Yoshikawa et al. | 346/157 |
| 5,066,979 | 11/1991 | Goto et al. | 355/208 |
| 5,227,842 | 7/1993 | Hayashi et al. | 355/208 |
| 5,293,198 | 3/1994 | Sawayama et al. | 399/49 |
| 5,410,388 | 4/1995 | Pacer et al. | 399/49 |

FOREIGN PATENT DOCUMENTS

| | | |
|---|---|---|
| 5-113723 | 5/1993 | Japan . |
| 5-346724 | 12/1993 | Japan . |

*Primary Examiner*—Arthur T. Grimley
*Assistant Examiner*—Quana Grainger
*Attorney, Agent, or Firm*—Fitzpatrick, Cella, Harper & Scinto

[57] ABSTRACT

An image forming apparatus includes an image bearing member electrostatic latent image forming device for forming an electrostatic latent image on the image bearing member, the image forming device forming, on the image bearing member, an electrostatic latent image usable for controlling image formation. A developing device is provided for developing an electrostatic latent image on the image bearing member, a density difference detecting device is provided for detecting a density difference in an image for the control developed by the developing device, and a control device is provided for controlling a developing condition of the developing device on the basis of an output of the density difference detecting device.

7 Claims, 5 Drawing Sheets

IMAGE FORMING APPARATUS WITH DEVELOPMENT CONTROL BASED ON DENSITY DETECTION OF DEVELOPED CONTROL IMAGE

This application is a continuation of application Ser. No. 08/359,729 filed Dec. 20, 1994, now abandoned.

FIELD OF THE INVENTION AND RELATED ART

The present invention relates to an image forming apparatus such as an electrophotographic type or electrostatic recording type copying machine or printer.

In an image forming apparatus of an electrophotographic type, the image density significantly changes depending on changes in the operating condition, number of prints or the like. Therefore, it is conventional to effect image density control wherein a rectangular density detection toner image (patch image) is formed as a test in a transfer drum or a photosensitive drum in accordance with a predetermined signal, and the density thereof is detected by an optical sensor or the like, and the result of the detection is fed back to control an image forming condition, such as a developing bias or the like, so that a predetermined density toner image is formed in response to a predetermined image signal.

However, if the toner is not sufficiently charged by triboelectricity under a high humidity condition or the like in the electrophotographic image forming apparatus, a so-called "trailing edge concentration" in which the density of a trailing edge portion g (downstream side with respect to the movement direction of the patch) is remarkably higher than the other portions G, as shown in FIG. 8, occurs, with the result of difficulty in forming a uniform patch image. If this occurs, correct image density setting is not possible.

It has been considered that the density of the patch image to be measured for the image density control is determined as an average of densities at different points in the patch as shown in FIG. 9. Even if this is done, the correct determination of the density is not possible, however, if the edge has a significant high density, so that correct density control is not possible. When the trailing edge concentration occurs, a high quality image formation is not possible.

SUMMARY OF THE INVENTION

Accordingly, it is a principal object of the present invention to provide an image forming apparatus capable of providing sufficient density of a developed image without trailing edge concentration.

According to an aspect of the present invention, there is provided an image forming apparatus that includes an image bearing member, and an electrostatic latent image forming device for forming an electrostatic latent image on the image bearing member, the image forming device forming, on the image bearing member, an electrostatic latent image usable for controlling image formation. A developing device is provided for developing an electrostatic latent image on the image bearing member, density difference detecting means is provided for detecting a density difference in an image for the control developed by the developing device, and a control device is provided for controlling a developing condition of the developing device on the basis of an output of the density difference detecting means.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
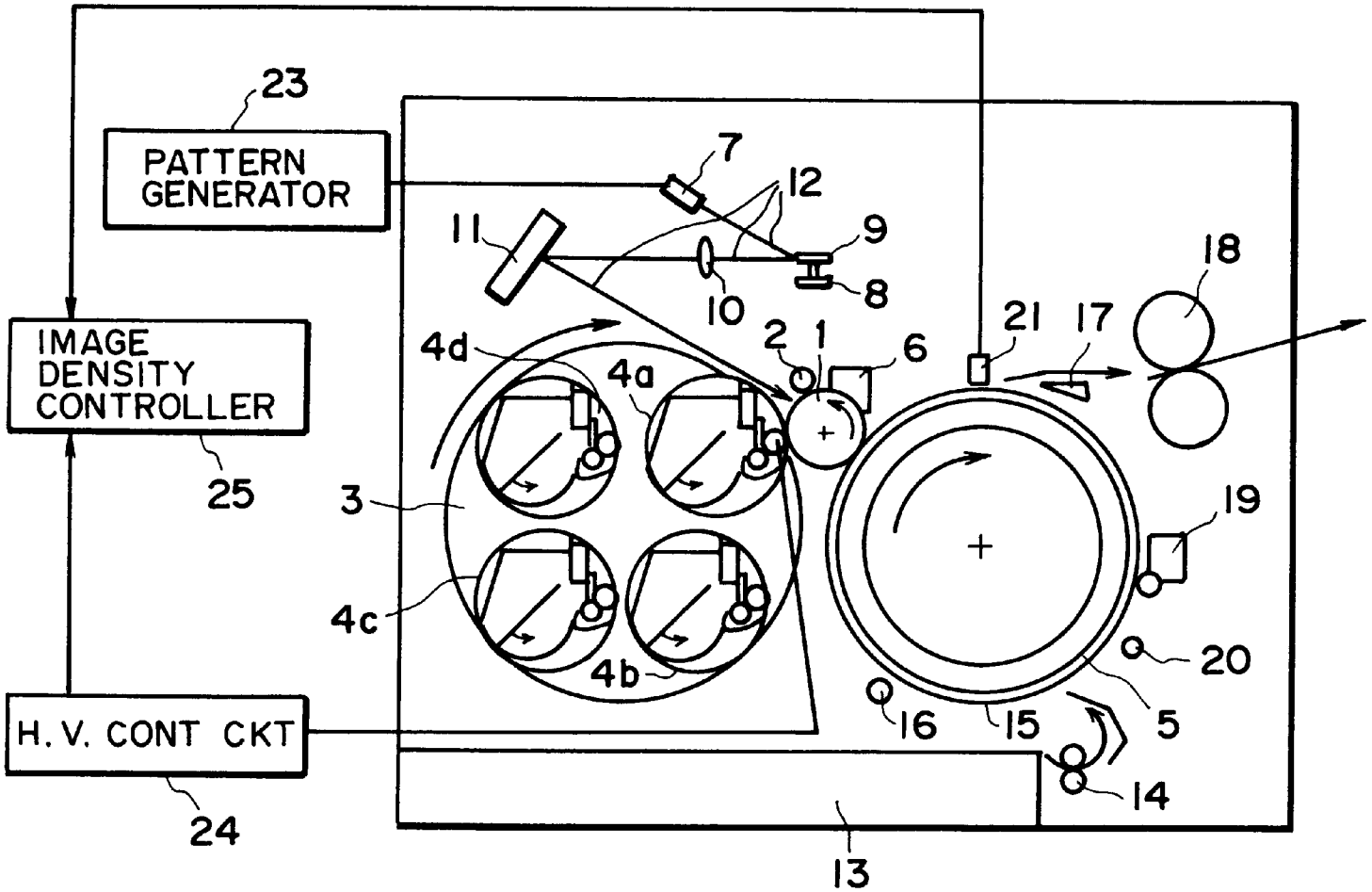
FIG. 1 illustrates an image forming apparatus according to first and second embodiments of the present invention.

Referring to the accompanying drawings, embodiments of the present invention will be described. FIG. 1 is a longitudinal sectional view of a color image forming apparatus using the present invention. The apparatus A has an electrophotographic photosensitive drum 1, a roller charger 2, and developing devices 4*a*, 4*b*, 4*c* and 4*d* containing different color toners at the left side of the photosensitive drum 1. The developing devices are supported on a rotatable support 3.

At the left side there is disposed a transfer drum 5 for carrying a transfer material (not shown) and for transferring an image from the photosensitive drum 1 onto the transfer material. The photosensitive drum 1 is rotated in the direction indicated by an arrow by an unshown driving means. At the upper portion of the apparatus, there are a laser diode 7, a polygonal mirror 9 driven by a high speed motor 8, a lens 10 and a focusing mirror 11.

When the laser diode 7 receives a signal corresponding to a yellow image pattern, light information corresponding to yellow color is projected onto the photosensitive drum 1 through an optical path 12, so that a latent image is formed. When the photosensitive drum 1 advances further in the direction of the arrow, the latent image is visualized by toner in the developing device 4*a*.

When the transfer material is fed by a pick-up roller 14 from a cassette 13 in synchromism with the image on the photosensitive drum 1, the leading edge of the transfer material is gripped by a gripper 15 of the transfer drum 5, and the transfer material is electrostatically attracted to the transfer drum 5 by a voltage applied between an attraction roller 16 and the transfer drum 5 carrying the transfer material, and the toner image on the photosensitive drum 1 is transferred onto the transfer material.

The above process is repeated for the magenta, cyan and black toners, so that a full color image of the plurality of colors is formed on the transfer material. The transfer material is separated from the transfer drum 5 by separation claws 17, and is then subjected to an image fixing operation in an image fixing device 18, so that the surface toner image is fused and fixed into a permanent full color image.

The toner remaining on the photosensitive drum 1 is removed by a cleaning device 6 including a fur brush, or like. Also, the toner on the transfer drum 5 is removed by the transfer drum cleaning device 19 including a fur brush, web or the like. Thereafter, the residual charge on the transfer drum 5 is removed by a discharging roller 20.

Figure 2:
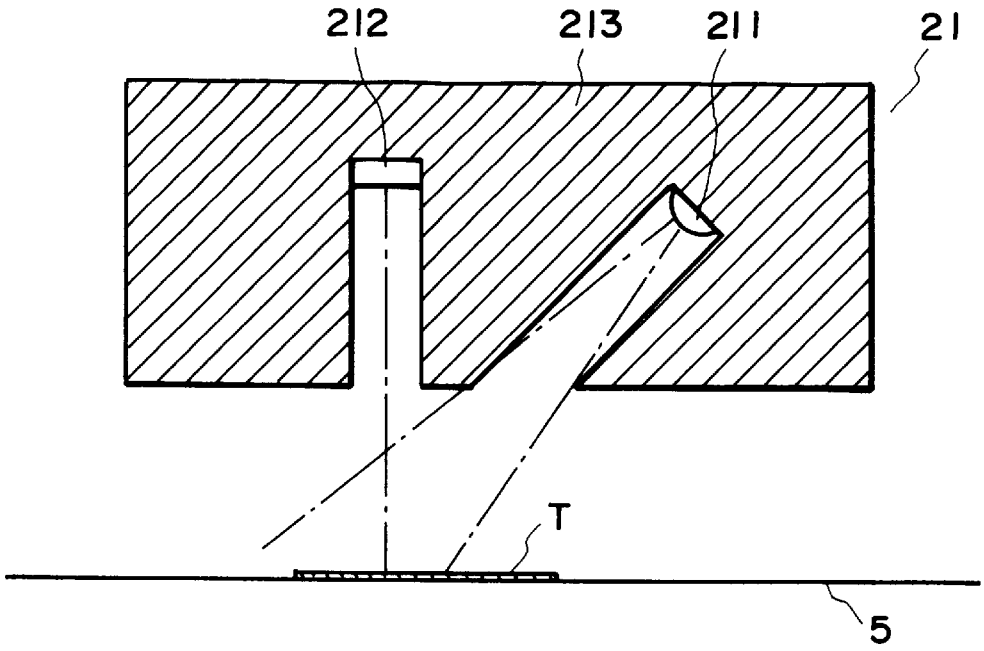
FIG. 2 is a longitudinal sectional view of a sensor used in embodiments of the present invention.

A density sensor 21 comprises, as shown in FIG. 2, a light emitting element 211, a photoreceptor 212 in the form of a photodiode or CdS, a holder 213, and functions to sense the toner density of the patch T.

Figure 3:
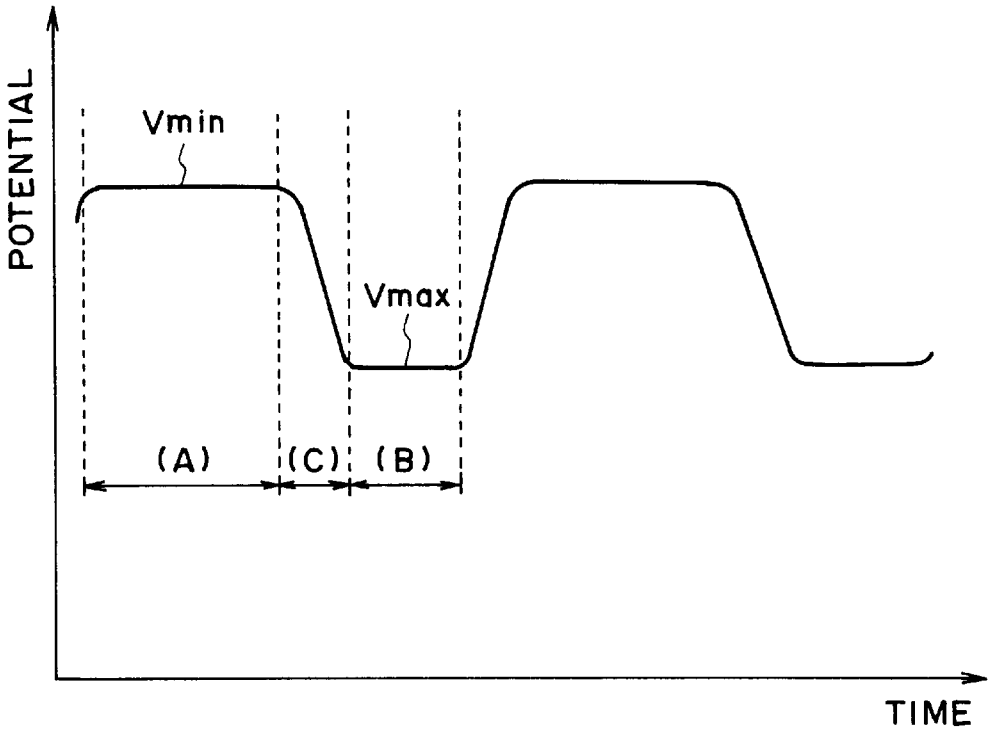
FIG. 3 shows a waveform of a developing bias voltage used in this invention.

A description will be made as to the developing bias voltage used in this embodiment. As shown in FIG. 3, in this embodiment, use is made of a falling regulated bias voltage. One period of the AC component of the developing bias voltage, comprises a phase A (toner back-transfer phase) wherein an electric field is formed in a direction of urging the toner from the photosensitive drum 1 to a developing sleeve (Vmin), a phase B (toner transfer phase) wherein an electric field is formed in a direction of urging the toner from the developing sleeve to the photosensitive drum 1 (Vmax), and a regulated falling phase C from Vmin to Vmax.

Figure 4:
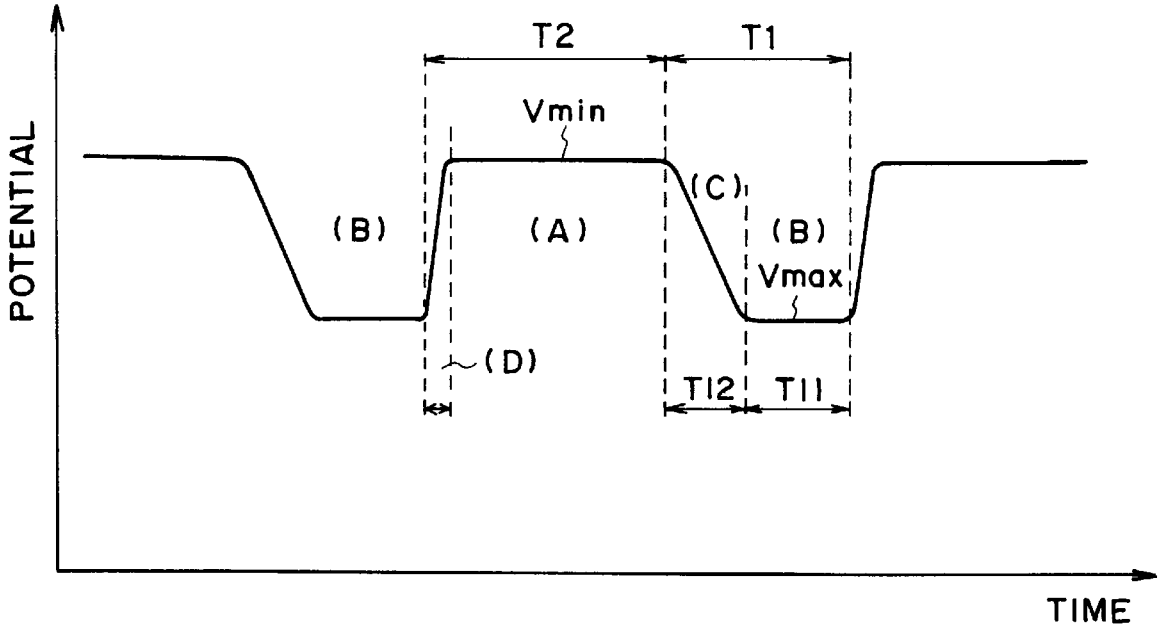
FIG. 4 illustrates process in one period of an AC component of the developing bias voltage used in this invention.

More particularly, as shown in FIG. 4, in the one period, there is a rising phase D from the transfer phase B to the back-transfer phase A. A total time period of phases A and D is T2, and that of phase B is T1, and that of phase C is T12, and that of total of T11 and T12 is T1, and the duty percentage and the inclination percentage are defined as follows:

$$\text{duty percentage } (\%)=(T1/(T1+T2))\times 100$$

$$\text{inclination percentage } (\%)=(T11/T1)\times 100=(T11/(T11+T12))\times 100$$

For all duty percentages ranging between 5.0–95.0, the inclination percentage is 60.0–90.0%. By so selecting, the trailing edge concentration is suppressed down to practically no problem level. The inventors have confirmed that the trailing edge concentration is completely removed if the inclination percentage is 0.5–60%. In view of this, the initial settings of the duty percentage and the inclination percentage are 35% and 54%, respectively. The inventors have also confirmed that the image density can be controlled by changing Vmin.

In this embodiment, maximum density control (Dmax control) is used wherein the image density control is affected so as to provide a predetermined maximum density (Dmax). The maximum density control will be described.

The Dmax control mode is selected, at a proper timing such as at main switch actuation, after a predetermined number of prints, or upon a change in the ambient condition. Then, a pattern generating circuit 23 produces an image signal for the Dmax control. In accordance with the signal, 5 patch latent images PD1–PD5 are formed on the photosensitive drum 1. These images are developed by the developing device 4*a* with developing bias voltages M1–M5 which are predetermined and provided from high voltage control circuit 24 and which have different Vmin. The developed patch images are transferred onto the transfer drum 5, so that patch images PD1–PD5 for the the yellow color density measurement are formed on the transfer drum 5. The densities of the patch images are measured by density sensor 21 at predetermined timings and the outputs thereof are supplied to the image density control circuit 25.

Figure 5:
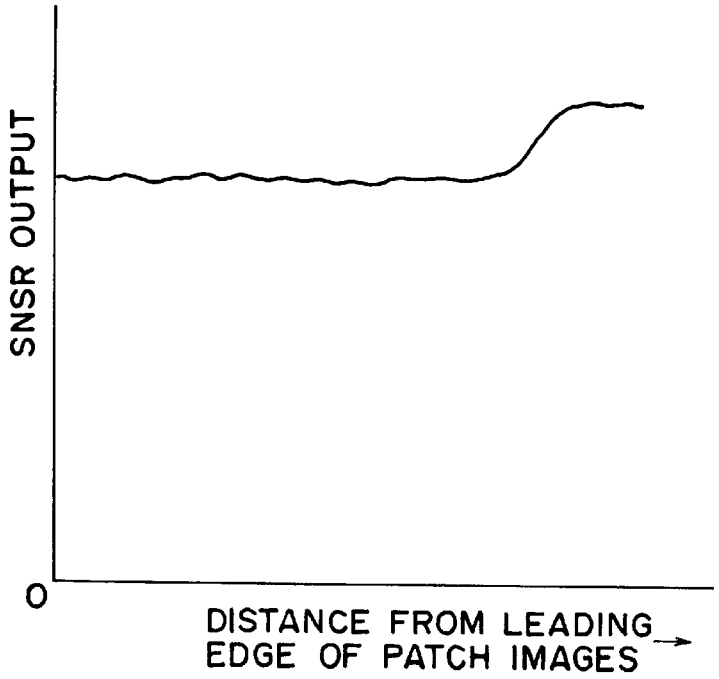
FIG. 5 shows a sensor output from a patch image with the trailing edge concentration.
Figure 6:
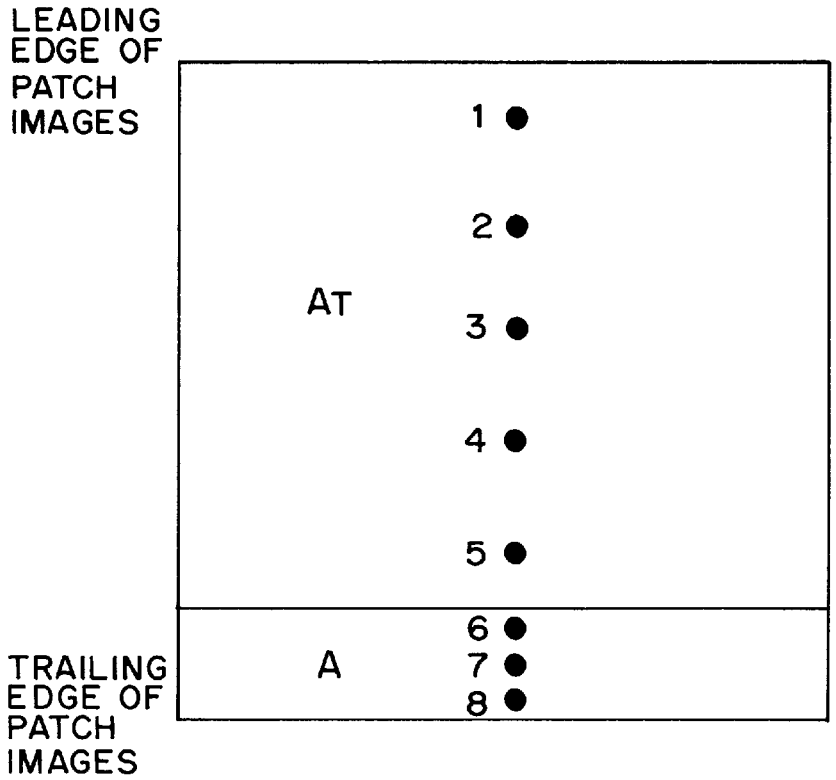
FIG. 6 illustrates measuring points of a patch image in an embodiment of the present invention.
Figure 7:
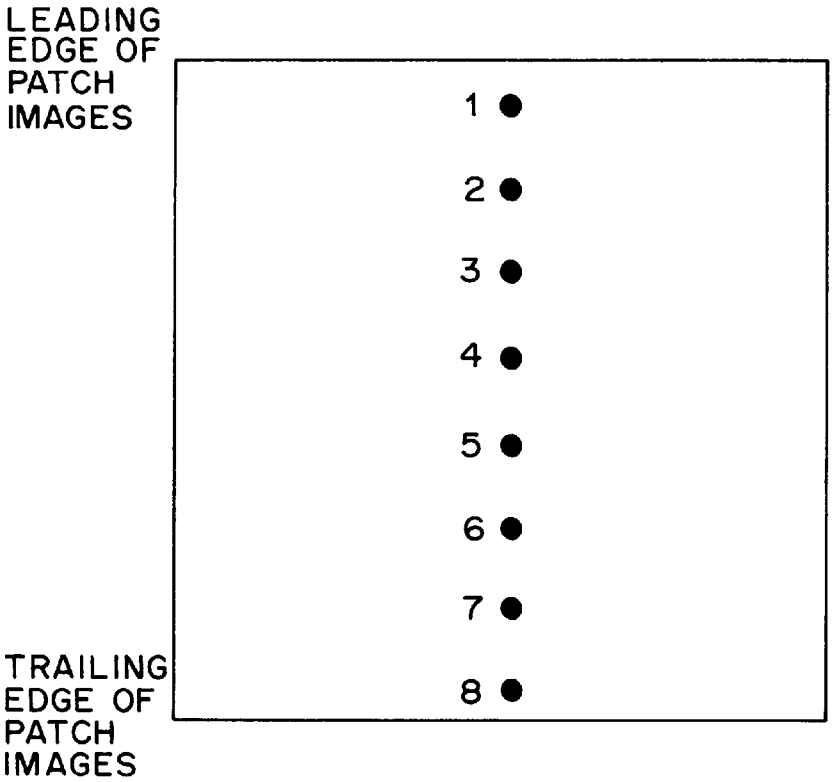
FIG. 7 illustrates measuring points of a patch image after the trailing edge concentration is suppressed in this invention.
Figure 8:
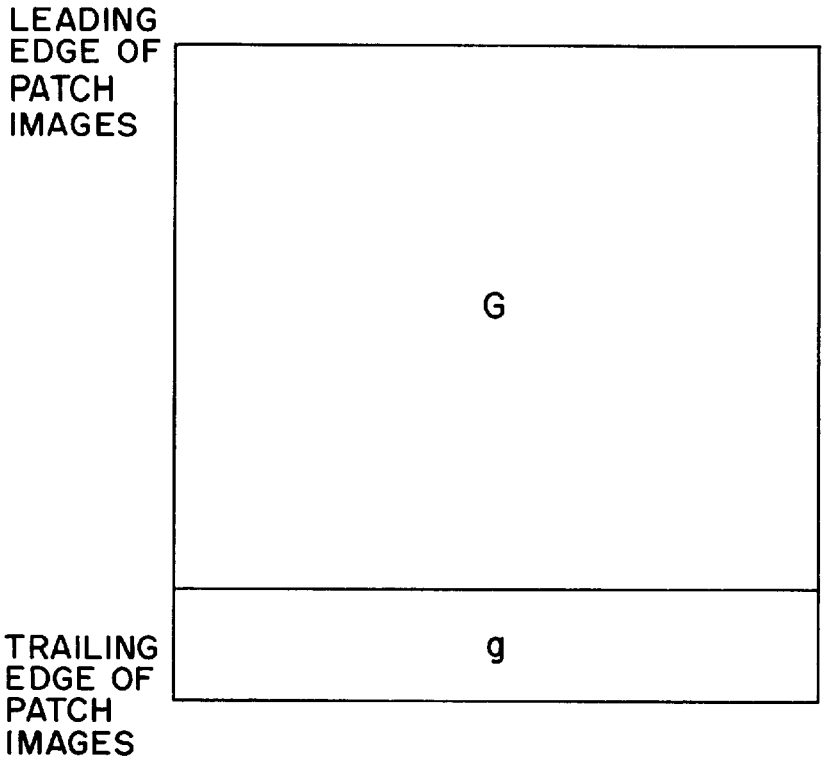
FIG. 8 illustrates the trailing edge concentration.
Figure 9:
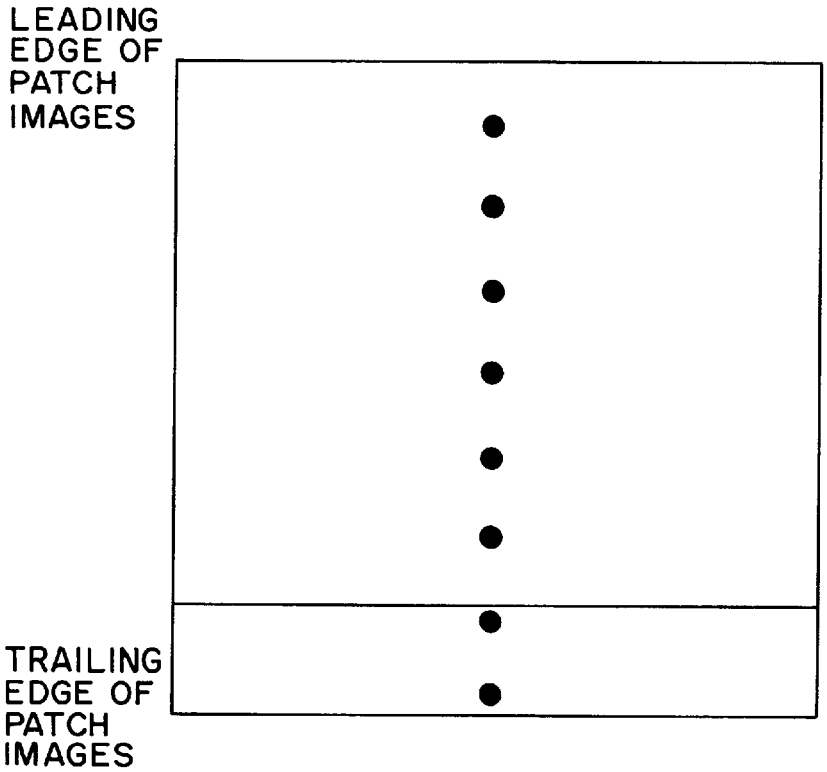
FIG. 9 illustrates an example of measuring points of the density detections.

As to the sensor output when the patch image with the trailing edge concentration is sensed, the output is large at the downstream side with respect to the patch image movement direction, as shown in FIG. 5. Therefore, the densities are measured at 8 points as shown in FIG. 6, and "no occurrence of the trailing edge concentration" is determined when the difference between an average AB for points 6–8 and average AT for points 1–5, is lower than a predetermined level A. Further, the density of the patch image is determined as an average of AT and AB. Therefore, if there is no trailing edge concentration, then the densities D1–D5 are obtained from the patch images. Using the data D1–D5 and the corresponding bias voltages M1–M5, the image density control circuit 25 calculates the Vmin required for providing the maximum density Dmax(1.5 in this example). This value is set as a yellow color developing bias. After the setting for yellow is determined, the next color control is effected.

If the difference exceeds the predetermined level, occurrence of the trailing edge concentration is determined. When the trailing edge concentration is observed for one color, it also occurs for other colors. It has been confirmed that the density AT with the trailing edge concentration is lower than that without the trailing edge concentration by approx. 0.2. Using these AT1–AT5 values and the used developing bias voltages M1–M5, the image density control circuit 25 calculates Vmin required for providing Dmax minus 0.2 (1.3 in this example), and this is deemed as Vmin-Y for yellow color for Dmax.

A description will be made as to the control for preventing the trailing edge concentration. The developing bias voltage used in this embodiment has a nature of suppressing the trailing edge concentration from the beginning. But, if the triboelectric charge of the toner is not enough under high humidity conditions or the like, then the trailing edge concentration can occur. The inventors have confirmed that the trailing edge concentration can be removed by reducing the inclination percentage beyond the initial setting. In view of this, in the present embodiments, a plurality of patch images are developed with developing bias voltages having different inclination percentages, and among then, the developing bias voltage having exhibited a no trailing edge concentration is selected.

First, a pattern generating circuit 23 generates an image signal for Dmax control, in accordance with which 8 patch images P1, P2, P3, P4, P5, P6, P7 and P8 are formed. The patch images are developed by the developing device 4*a*, during which different developing bias voltages are supplied for the patch images P1–P9, respectively. The developing bias voltages K1–K8 are 50%, 46%, 42% - - - 22%, namely, gradually decrease. As the Vmin, use is made of Vmin-Y described above. The patch images are then transferred onto the transfer drum 5.

The image densities of the patch images are sensed by the sensor 10 at predetermined timings, and the outputs thereof are supplied to image density control circuit 25. In the same manner as described above, the difference is obtained to check whether the trailing edge concentration occurs or not, for P1, P2 etc. Among the patch images not exhibiting the trailing edge concentration, the largest inclination one is selected as the inclination percentage for the subsequent image forming operations for yellow color. Thus, the Vmin and inclination percentage for yellow are determined for the y, and similar operations are repeated for the other colors to determine Dmax.

After completion of Dmax control for the respective toner color, a patch image having stabilized density without trailing edge concentration can be provided.

EMBODIMENT 2

A description will be made as to a second embodiment, referring back to FIG. 1. In the first embodiment, for the Vmin when the trailing edge concentration occurs, predetermined dmax minus 0.2 is used as a target level for the Dmax control. However, this may not be proper due to deterioration of the toner or that of the photosensitive drum. In view of this, when the trailing edge concentration occurrence is observed in the patch image, the Dmax control is effected again as in the control in the first embodiment. By doing so, the predetermined Dmax is reliably obtained in the present embodiment.

In this embodiment, when the trailing edge concentration occurs for the yellow toner patch image, for example, the potential Vmin-Y and the inclination percentage Ky are determined through control as in embodiment 1, and then, an image signal for Dmax control is generated by the pattern generating circuit 23, and in accordance with this signal, 5 patch images PD1–PD5 are formed on the photosensitive drum 1 as latent images.

The latent images PD1–PD5 are developed with different developing bias voltages S1–S5 supplied from high voltage control circuit 24, respectively. The developing bias voltages S1–S5 are selected on the basis of the potential Vmin-Y and inclination percentage Ky. Ky is common for all developing bias voltages S1–S5, and the potential Vmin are as follows:

S1: Vmin-y−2Vo

S2: Vmin-y−Vo

S3: Vmin-y

S4: Vmin-y+Vo

S5: Vmin-y+2Vo where Vo is a predetermined offset voltage (20V in this Example).

Thus, the developer S1–S2 are selected using Vmin values symmetrical with the center of Vmin-Y.

The patch image developed with the different developing bias voltages are transferred onto the transfer drum 5, so that patch images PD1–PD5 for density control for yellow color are measured on the transfer drum 5. The density thereof is detected by density sensor 21 at predetermined timings, and the outputs thereof are supplied to the image density control circuit 25. The density detections are effected for 8 points in a patch image, and an average thereof is used as each of patch densities D1–D5. Using the densities D1–D5 and the developing bias voltages S1–S5, the Vmin required to provide the predetermined density Dmax (1.5 in this example) is calculated by image density control circuit 25. On the basis of this calculation, the developing bias voltage for yellow is finally determined.

The above described control operation is effected for each of the respective color toners when the trailing edge concentration occurs, by which a stabilized patch image can be formed without trailing edge concentration.

In the foregoing embodiments, the Dmax control is used for the image density control, but another control to provide the desired density level can be effected.

The present invention is not limited to the above described embodiments, but various modifications are possible. For example, the order of colors, or the number of the patch images may be changed. The density detection is not limited to an optical one. The density detection position is not limited to the surface of the transfer drum, but may be the surface of the photosensitive drum or the surface of the transfer material. The waveform of the developing bias voltage may be changed if similar effects are provided.

The present invention is not limited to a color image formation, but is applicable to monochromatic image formation. The developer may be a one component or two component developer.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus comprising:

an image bearing member;

electrostatic latent image forming means for forming an electrostatic latent image on said image bearing member and for forming on said image bearing member a test electrostatic latent image usable for controlling image formation;

developing means for developing the electrostatic latent image and the test electrostatic latent image on said image bearing member with toner, said developing means repeatedly and alternatingly forms first and second electric fields between itself and said image bearing member to alternatingly impart to the toner a force toward said image bearing member and a force away from said image bearing member, said first and second electric fields continuing with constant intensities;

density detecting means for detecting a density of a developed test electrostatic latent image, said density detecting means detecting densities at a plurality of positions in the developed test electrostatic latent image;

electric field controlling means for controlling a a ratio of a time duration required to change from the first electric field to the second electric field to a time duration from an end of the first electric field to an end of the second electric field, on the basis of the densities at the plurality of positions detected by said density detecting means.

2. An apparatus according to claim 1, wherein the plurality of positions are arranged in a movement direction of said image bearing member.

3. An apparatus according to claim 2, wherein the time is controlled on the basis of comparison between an average of the detected densities at a plurality of upstream positions and an average of the detected densities at a plurality of downstream positions.

4. An apparatus according to claim 3, wherein the time is changed when a difference between the averages is larger than a predetermined value.

5. An apparatus according to claim 1, wherein said electric field control means controls an inclination between a waveform of the first and a waveform of the second electric field.

6. An apparatus according to claim 1, wherein when said electric field controlling means changes the time, said electrostatic latent image forming means again forms the electrostatic latent image.

7. An apparatus according to claim 1, wherein the first electric field imparts to the toner the force away from said image bearing member, and the second electric field imparts to the toner the force toward the image bearing member.

* * * * *

UNITED STATES PATENT AND TRADEMARK OFFICE

CERTIFICATE OF CORRECTION

PATENT NO. : 5,940,654
DATED : August 17, 1999
INVENTOR(S) : Akihiko Uchiyama, et al.

It is certified that error appears in the above-identified patent and that said Letters Patent is hereby corrected as shown below:

Title Page:

Section [73] ASSIGNEE:

"Canon Kabushiki Kaisha," should read -- Canon Kabushiki Kaisha, --.

Column 2:
Line 52, "synchromism" should read -- synchronism --.

Column 4:
Line 36, "then," should read -- them, --.

Signed and Sealed this

Twenty-first Day of August, 2001

*Attest:*

Nicholas P. Godici

*Attesting Officer*

NICHOLAS P. GODICI
*Acting Director of the United States Patent and Trademark Office*